United States Patent [19]

Borio et al.

[11] 4,438,709

[45] Mar. 27, 1984

[54] SYSTEM AND METHOD FOR FIRING COAL HAVING A SIGNIFICANT MINERAL CONTENT

[75] Inventors: Richard W. Borio, Somers; Hugh W. Nelson, West Hartford, both of Conn.; Arun K. Mehta, Los Altos, Calif.

[73] Assignee: Combustion Engineering, Inc., Windsor, Conn.

[21] Appl. No.: 423,591

[22] Filed: Sep. 27, 1982

[51] Int. Cl.[3] ..... F23K 1/00; F23D 1/00

[52] U.S. Cl. ..... 110/347; 110/263

[58] Field of Search ..... 110/347, 263, 261, 262, 110/342

[56] References Cited

U.S. PATENT DOCUMENTS

| | | | |
|---|---|---|---|
| 3,229,650 | 1/1966 | Reichl | 110/347 |
| 3,229,651 | 1/1966 | Wasp | 110/347 |
| 4,246,853 | 1/1981 | Mehta | 110/263 |
| 4,253,403 | 3/1981 | Vatsky | 110/263 |
| 4,259,911 | 4/1981 | Jones | 110/263 |
| 4,315,734 | 2/1982 | Ramesohl et al. | 110/347 |
| 4,349,331 | 9/1982 | Floter | 110/347 |

*Primary Examiner*—Henry C. Yuen

*Attorney, Agent, or Firm*—Arthur L. Wade

[57] ABSTRACT

A conventional pulverized coal-fired furnace is supplied fuel at two different levels. The raw coal is classified into a stream of relatively pure coal ground to conventional fineness for burners at the lower level, and a stream of very finely divided coal with a large, heavy mineral content for burners at the higher level.

5 Claims, 1 Drawing Figure

SYSTEM AND METHOD FOR FIRING COAL HAVING A SIGNIFICANT MINERAL CONTENT

TECHNICAL FIELD

Figure 1:
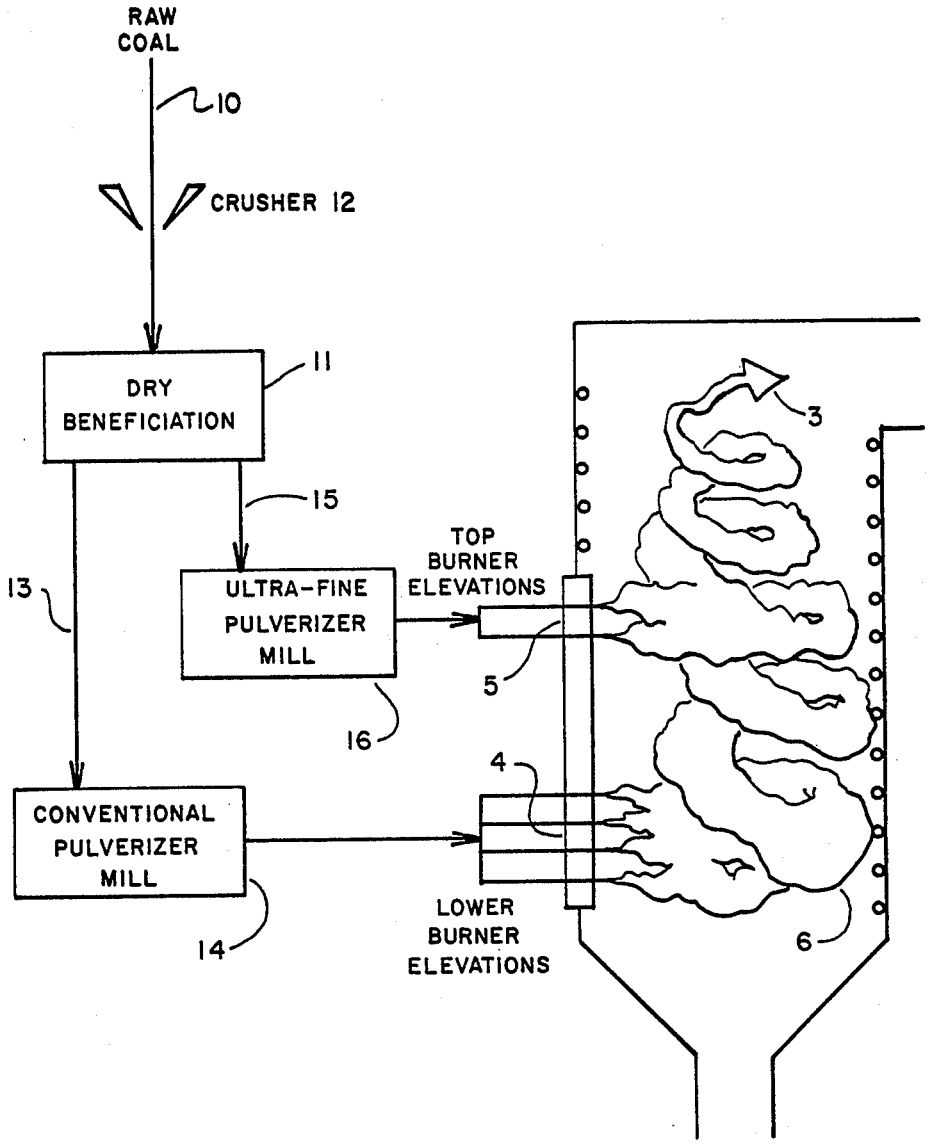

The present invention relates to the combustion of coal which contains a significant amount of mineral matter, such as pyrite. More particularly, the invention relates to rapid roasting of finely ground minerals, such as pyrite, to refractory oxides like $Fe_2O_3$ to avoid slagging of the furnace walls.

BACKGROUND ART

Coal with iron content (principally pyrites) concentrated in the heavy (2.9 sink) fraction have shown more tendency to slag than those in which the iron is widely distributed among the various gravity fractions of the coal. The analysis of furnace slags show them to be richer in iron than ash from the coals fired. Iron compounds, particularly the iron sulfides like pyrite ($FeS_2$) and pyrohtite (FeS) have a much lower melting point and higher specific gravity than most other minerals in coal and coal ash.

Pyrite initially oxidizes to pyrohtite in a boiler flame by the following reaction (1): (1) $FeS_2O_2 \rightarrow FeS + SO_2$. The product FeS forms molten spheres which, due to less aerodynamic drag and higher density (compared to other particles in the furnace fireball), are more likely to mechanically impact and stick on the walls of the furnace. Subsequent chemical reactions between FeS and ash already present on the boiler tubes can form a relatively low-melting slag. Reactions (2) and (3) show the following slag-forming sequence:

(2) $2FeS(s) + 3O_2(g) \rightarrow 2FeO(s,l) + 2SO_2(g)$ (3) $FeO(s) + SiO_2(s,l) \rightarrow FeSiO_3(s,l)$ Code: s=solid; I=liquid; g=gas Reaction (3) shows the creation of low-melting ferrous silicate slag (2096° F. melting point).

The formation of low-melting slag deposits on furnace water wall tubes is thus greatly enhanced by iron sulfides when they are concentrated in the heavy gravity fraction of a coal.

What is needed is a method and means to grind pyrites or other harmful coal mineral matter to a finely divided state, concentrate them, and insert them into the combustion process at a temperature high enough to quickly convert them to the high melting iron oxides like $Fe_2O_3$, or $Fe_3O_4$ in the case of pyrites. Converted to this form, the iron compounds and other potentially harmful minerals will not adhere to the furnace wall upon impact, but act as dry collectable ash which will be entrained by the flue gas and therefore is removed from the furnace.

DISCLOSURE OF THE INVENTION

The present invention contemplates receiving raw crushed coal into a dry beneficiation system which divides the raw coal into a relatively mineral-free stream and a second stream with a relatively high concentration of mineral matter. It is contemplated that the stream of pure coal will be pulverized to a conventional size for normal combustion within a furnace; the coal passes through those burners located at a relatively low elevation within the furnace. The second stream will be passed through a special type of pulverizer to finely divide the high mineral content coal fraction and feed this stream into burners at a relatively high elevation within the furnace so that the high mineral fraction will be subjected to a high temperature which will quickly roast the pyrites of the mineral fraction into the refractory iron oxides, $Fe_2O_3$ and/or $Fe_3O_4$, and give less opportunity for other minerals to deposit as low melting slag.

Other objects, advantages and features of this invention will become apparent to one skilled in the art upon consideration of the written specification, appended claims, and attached drawing.

BRIEF DESIGNATION OF THE DRAWING

FIG. 1 is a diagrammatic representation of a coal preparation system and furnace embodying the present invention.

BEST MODE FOR CARRYING OUT THE INVENTION

Terms and Technology

The Background Art section supra has established several benchmarks for terms associated with the disclosure of the invention. Pyrites have been identified specifically as $FeS_2$, the principal mineral constituent of the coal which provides the present problem in its combustion within a furnace. Under present practice, pyrite has the end result of producing low-melting slag which coats the heat exchange walls of the furnace and lowers the efficiency of heat transfer through these walls. It is possible, by classification (beneficiation) techniques utilizing gas streams, to separate pure coal from that fraction of the coal bound up with minerals such as pyrite. The end result is that the heavier, more dense, fraction of mineral-bearing coal still contains a significant percentage of burnable coal. It is the present objective of the invention to insert this mineral-heavy coal fraction into the furnace so that the heat may be extracted from the coal in combustion and simultaneously insure that the mineral matter contained in it will not promote the formation of slag.

Size reduction of the coal and its mineral content is carried out by two kinds of mills. A first mill is provided to reduce the raw coal to a size suitable for the so-called classifier (beneficiator). A second mill is provided for the pure coal fraction from the classifier. A third mill is provided for the hard mineral-dense coal from the classifier. The classifier, itself, is a device which utilizes a gaseous stream to separate the lighter pure coal from the higher mineralized fraction.

The General System

Once the coal classification (beneficiation) system has provided a relatively pure first stream of coal, a conventional mill pulverizes this coal to a suitable size for those burners at the lowest elevation within the furnace. Combustion of this coal discharge from the lower burners of the furnace creates the fireball within the furnace which produces the main portion of the heat passed through the walls of the furnace and into the water which is to be turned into steam.

Within the concept of the present invention, the mineral-bearing coal stream is pulverized by a special type of mill which supplies the mixture to burners in an elevated portion of the furnace. Introduced at this elevation, the finely-divided pyrite is subjected to a high enough temperature to be quickly roasted into $Fe_2O_3$ and/or $Fe_3O_4$, and there is less opportunity for other materials to impact upon furnace walls. This material will not readily stick to the furnace walls because of its fine size and favorable aerodynamic characteristics, but will stay with the gas stream and be removed as fly ash.

It is contemplated that the combustion air supplied to the two groups of burners will be balanced to decrease both pyrite and $NO_x$, i.e. lower stoichiometries in the bottom elevations and higher stoichiometries in higher elevations.

The Drawing

In the drawing, furnace portion 1 is disclosed to form a locus for the combustion of solid, pulverized fuel discharged from burners mounted through the wall of the furnace. The heat of the combustion is, of course, transferred to water flowing through tubes which form the walls of the combustion chamber of the furnace. This water is heated to produce the steam which is the ultimate result sought by burning fuel in the furnace. The heated combustion products ascend as indicated by arrow 3 for further heat exchange duty and carry with them a greater portion of ash than occurs with conventional firing.

The bank of burners is divided into two sections. The burners of section 4 are physically located in the lower part of the furnace. Section 5 burners are physically located in the upper part of the furnace. It is intended that pulverized coal supplied to burners of section 4 will form fireball 6 wherein its more air-rich portion 7 is expected to be at the same level of the burners of section 5. From this overall organization within furnace 1 it can be appreciated that if the walls are lined with tubes which conduct water to be converted into steam, the efficiency of heat transfer from the combustion into the water would be impaired by slag if it formed on, adhered to, and coated the external surface of the tubes. It is the primary object of the present invention to avoid the formation of slag.

Conduit 10 represents a source of raw coal for the burners of the furnace. The present disclosure assumes this coal has a high mineral content (>15% ash) including iron pyrites, $FeS_2$. If this coal is fired in the conventional manner, it will promote the generation of slag on the surfaces of the furnace wall tubes. In embodiment of the present invention, the raw coal is prepared by classifier (beneficiator) 11. The coal is crushed by a mill 12 and delivered to classifier 11 where a gaseous stream is utilized to divide the coal into two streams. The first stream of coal immerges from the classifier through conduit 13. If the classifier has functioned as expected, the coal of conduit 13 will be substantially lower in mineral content and be suitable for "clean" combustion in the lower burners of furnace 1. This clean coal will be pulverized in mill 14 for combustion in the burners of section 4 as the basic combustion within furnace 1.

Classifier (beneficiator) 11 produces a second stream of mineral-dense coal which is pulverized by a special mill and fed to the burners of section 5. Theoretically, it would appear desirable to simply dispose of the mineral-bearing coal from classifier 11 as trash and keep it out of furnace 1. However, economics dictate the recovery of the heating value of this coal. Under the concept of the present invention, this mixture of minerals and coal is inserted into furnace 1 at a location where the coal will add to the combustion and the pyrites of the minerals will be converted into a form which will obviate the formation of slag, and other minerals, because of their fine size, will preferentially stay in the gas stream and be removed as fly ash.

Specifically, the second stream in conduit 15 is conducted to a mill 16 where the coal including the high mineral fraction is brought to an extremely small size. The high mineral fraction of coal of the second stream is then supplied to the burners of section 5 for discharge into the air richer portion of the furnace at a temperature high enough to quickly roast its pyrites into $Fe_2O_3$ and/or $Fe_3O_4$; the other minerals have also been ground to sufficiently fine sizes that they remain with the gas stream and are removed as fly ash, rather than forming furnace slag. Converted, the iron oxide-rich compounds will not adhere to the walls of the furnace, but will be carried out as fly ash with other finely ground ash and be disposed of in the normal manner.

Conclusion

The invention is embodied in both a process and apparatus, as disclosed. In the process, raw coal having a high mineral content is divided into two streams. The first stream of coal contains a very low mineral content and is suitable for conventional pulverizing and burning in the lower burners of a furnace. The second stream has been processed to concentrate the minerals of the original stream of raw coal, which minerals contain pyrites. This second stream of coal, with its mineral content, is pulverized to an extremely fine size, the better to roast the pyrites of the minerals into $Fe_2O_3$ and/or $Fe_3O_4$. This roasting is attained by supplying the second stream to burners in the furnace located vertically above the first set of burners, so the mineral-rich coal can be injected into a zone of air-rich combustion. The final result is a conversion of the mineral content of the coal into a form which will avoid slagging in the furnace while extracting the heat values from the coal.

The process is carried out in structure which embodies the invention. This structure includes the equipment required to crush the initial stream of raw coal, divide the crushed coal into the two streams, pulverize the first stream of relatively mineral-free coal and burn the first stream of conventionally pulverized coal in the lower part of the furnace. The equipment also includes the pulverizer receiving the second stream of mineral-rich coal and injecting that finely pulverized stream of coal and minerals into the combustion zone of the furnace where the temperature is high enough to effectively roast the pyrites of the minerals.

From the foregoing, it will be seen that this invention is one well adapted to attain all of the ends and objects hereinabove set forth, together with other advantages which are obvious and inherent to the method and apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawing is to be interpreted in an illustrative and not in a limiting sense.

We claim:

1. A combustion system for mineralized coal, including, a source of coal having a significant content of iron pyrite ($FeS_2$) in its total mineral fraction, a classifier (beneficiator) connected to the source of coal to receive and divide the coal into a first stream of substantially pure coal and into a second stream of coal with a highly concentrated content of iron pyrite and other minerals, a furnace having two sets of burners arranged vertically one over the other, means connected between the classifier and the lower of the two sets of burners to receive and pulverize the first stream of coal supplied the burners, and means connected between the classifier and the upper of the two sets of burners to receive and pulverize the second stream of coal to an extremely small size (≦400 mesh) and supplied the burners, whereby the combustion generated by the coal of the first set of burners extends up through the furnace so that the coal of the second set of burners ejects into the hot temperatures and air-richer zone of the combustion and thereby roasts the iron pyrites to iron oxide.

2. The system of claim 1, including, means for supplying combustion air to the two sets of burners of the furnace so that the fuel-air ratio of the lower set of burners is fuel-rich and the fuel-air ratio of the second set of burners is air-rich.

3. A combustion furnace in which coal having a significant mineral content is burned, including, a combustion chamber having tube-lined walls through which tubes water is conducted to be vaporized into steam, a first set of burners mounted through the lower wall of the chamber, a second set of burners mounted through the upper wall of the chamber, a supply of coal having a high mineral content which has a significant ferrous disulfide ($FeS_2$) content, means connected to the supply for receiving the coal and dividing it into a first portion of relatively demineralized coal and a second portion of mineralized coal, a first mill connected to the dividing means to receive the first coal portion and pulverize it to a conventional size for combustion in the lower portion of the furnace chamber, means connecting the first mill to the first set of burners, a second mill connected to the dividing means to receive and pulverize the second coal portion to an extremely fine size, and means for connecting the second mill to the second set of burners for injecting the mineralized coal into an elevated portion of the combustion chamber, whereby the mineralized portion of the coal will be roasted to high-melting compounds which will not adhere to the walls of the furnace upon impact and the mineralized portion of the coal will be injected at such a fine size that the ash particles formed will be retained with the flue gas and be removed as fly ash.

4. A process for burning highly mineralized coal, including, dividing raw coal with a high mineral content into a first stream of relatively low mineral content and a second stream of relatively high mineral content including pyrites, pulverizing the first stream of coal to a conventional size for combustion in a furnace, supplying the first stream of pulverized coal to a combustion zone in the lower portion of a furnace, pulverizing the second stream of mineralized coal to an extremely fine size, and supplying the second stream of finely pulverized mineralized coal to the high-temperature upper portion of the combustion zone in the furnace, whereby the pyrites of the mineral is roasted to $Fe_2O_3$ and/or $Fe_3O_4$ and all of the mineral content is prevented from forming slag in the furnace.

5. The process of claim 4, wherein, air is supplied to the combustion zone so that the fuel-air ratio of the lower portion of the zone is fuel-rich and the fuel-air ratio of the upper portion of the zone is air-rich.

* * * * *